US005308186A

United States Patent [19]

Hedgewick

[11] Patent Number: 5,308,186

[45] Date of Patent: May 3, 1994

[54] SNOWPLOWABLE ROAD MARKER

[75] Inventor: Peter Hedgewick, Windsor, Canada

[73] Assignee: Pac-Tec, Inc., Heath, Ohio

[21] Appl. No.: 822,542

[22] Filed: Jan. 17, 1992

Related U.S. Application Data

[63] Continuation-in-part of Ser. No. 527,754, May 23, 1990, Pat. No. 5,098,217.

[51] Int. Cl.[5] ..... E01F 11/00

[52] U.S. Cl. ..... 404/14; 404/16

[58] Field of Search ..... 404/9, 12, 15, 16; 116/63 R; 52/298; 40/612

[56] References Cited

U.S. PATENT DOCUMENTS

| | | | |
|---|---|---|---|
| 3,587,416 | 6/1971 | Flanagan . | |
| 3,693,511 | 9/1972 | Medynski | 404/16 X |
| 3,901,614 | 8/1975 | Overacker | 404/16 |
| 3,971,623 | 7/1976 | Hedgewick et al. | 404/16 X |
| 4,008,973 | 2/1977 | Montigny | 404/16 |
| 4,155,666 | 5/1979 | Flanagan . | |
| 4,195,945 | 4/1980 | Heenan . | |
| 4,402,628 | 9/1983 | Grenier et al. . | |
| 4,557,624 | 12/1985 | Walker . | |
| 4,577,992 | 3/1986 | Jefferies . | |
| 4,875,798 | 10/1989 | May | 404/12 |

*Primary Examiner*—Ramon S. Britts
*Assistant Examiner*—Roger J. Schoeppel
*Attorney, Agent, or Firm*—Gifford, Groh, Sprinkle, Patmore and Anderson

[57] ABSTRACT

A low profile snowplowable road marker and method of installation is disclosed. The snowplowable road marker has a circular top section with opposed dished surfaces extending from a peripheral edge. The peripheral edge is mounted in an outer bore below the level of the road surface. A bridge portion extends between a pair of channels. The bridge portion has at least one inclined wall having a recess for accepting a signalling device. A brow extends outwardly from the inclined wall over the recess to reduce contact between the tire of a vehicle passing over the road marker and the signalling device.

15 Claims, 2 Drawing Sheets

SNOWPLOWABLE ROAD MARKER

This is a continuation-in-part of copending application Ser. No. 07/527,754 filed on May 23, 1990, now U.S. Pat. No. 5,098,217.

BACKGROUND OF THE INVENTION

I. Field of the Invention

The present invention relates to road markers for reflecting the light of oncoming vehicles. More particularly, the present invention relates to snowplowable road markers.

II. Background of &he Invention

Road markers are known for marking traffic lanes and controlling the f low of traffic. Typically, the road markers have a body molded of plastic material and include one or more reflectors to return the light from headlights of oncoming vehicles. The plastic bodies are mounted directly on the top surface of the road as disclosed in U.S. Pat. No. 4,753,548.

However, in geographic areas where there is sufficient snow fall to require the use of snowplows to remove the snow, it has been found that snowplow blades frequently damage road markers or remove the markers from the road. To overcome this problem, it is known, such as disclosed in U.S. Pat. No. 3,587,416, to form a metal casting having a pair of spaced apart ramps mounted in the roadway surface. A cube corner reflector is mounted in the casting between the pair of ramps so that a snowplow blade will ride up the ramps and pass over the reflector without damaging the reflector.

It is also known, as disclosed in U.S. Pat. No. 4,577,992, to form a circular casting having a dished top surface with a channel extending across the top surface so that a snowplow blade is deflected by the dished top surface regardless of the angle from which the snowplow blade engages the top surface.

Likewise, U.S. Pat. No. 4,402,628 discloses a circular sheet metal base having a raised protected cross-rib extending between a pair of raised side members. The protective rib extends between a pair of markers which are disposed in channels extending radially from each side of the rib.

Because tires of vehicles frequently pass over the snowplowable road markers, it is advantageous to minimize the height of the road marker extending above the road surface to minimize the disturbance to the handling of the vehicle when passing over the road markers. Additionally, previously known snowplowable markers frequently are removed from the road or damaged by contact with snowplow blades. It has been found that snowplow blades will slice through the hardened steel pavement markers such as disclosed in U.S. Pat. No. 4,402,628. Likewise, it has been found that snowplow blades may ride under the peripheral edge of markers such as disclosed in U.S. Pat. No. 4,577,992 and remove the casting from the road.

SUMMARY OF THE INVENTION

The present invention overcomes these problems and provides a snowplowable road marker which has a low profile and is not easily removed from the road surface by snowplow blades. Additionally, the snowplowable marker of the present invention provides protection for the reflector from contact with the tire of a vehicle passing over.

The present invention is a snowplowable road marker having a dished top section and a mounting section for securing the marker to the roadway. The top section has a circular peripheral edge and at least one channel having a planar surface extending radially inwardly from the peripheral edge to a bridge section provided to mount and protect a signalling device. The top section further has an annular surface extending inwardly from the peripheral edge to the mounting section. A circular bore is formed in the road for accepting the annular surface and peripheral edge of the top section. The depth of the bore is equal to a predetermined spacing between the planar surface of the channel and annular surface so that the planar surface of the channel is aligned along the plane extending through the top surface of the road.

A second bore is formed coaxially with the first bore to accept the mounting section of the casting. In this manner, the profile of the casting is lowered to reduce disturbance to automobile traffic and the peripheral edge is positioned below the top surface of the road so that the first contact of the snowplow blade is with the dished surface of the top section to eliminate removal of the castings by contact from a snowplow blade.

Also disclosed is a center bridge for supporting a signalling device such as a "cats eye" reflector. The bridge is provided with a brow extending outwardly from the bridge and over the signalling device to protect the signalling device from contact with tires of an overpassing automobile.

A method of mounting the marker, including the steps of forming concentric bores and removing a center section from the inner bore is also disclosed.

BRIEF DESCRIPTION OF THE DRAWING

The objects, features, and advantages of the present invention will be readily apparent from the detailed description of the invention taken in connection with the accompanying drawing.

DETAILED DESCRIPTION OF THE DRAWING

Figure 1:
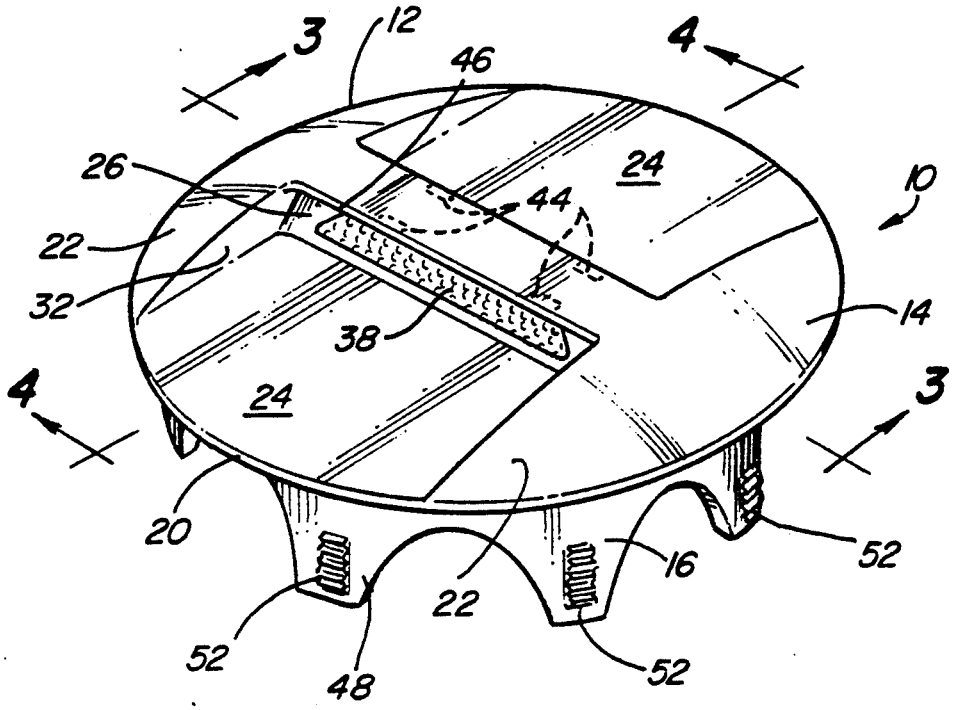
FIG. 1 is a perspective view of a road marker according to the invention.

As shown in FIG. 1, a snowplowable road marker constructed in accordance with the invention is generally shown at 10. The road marker includes a base member 12 having a dished top section 14 and a lower mounting section 16. The base member 12 of the present invention is preferably formed in a unitary construction of cast iron. However, the base member 12 may be formed of any material having sufficient strength and rigidity to carry out the objects of the invention. Additionally, it is a feature of the invention that the top section may be formed separately from the mounting section and joined together by a satisfactory means, such as threaded fasteners.

Figure 4:
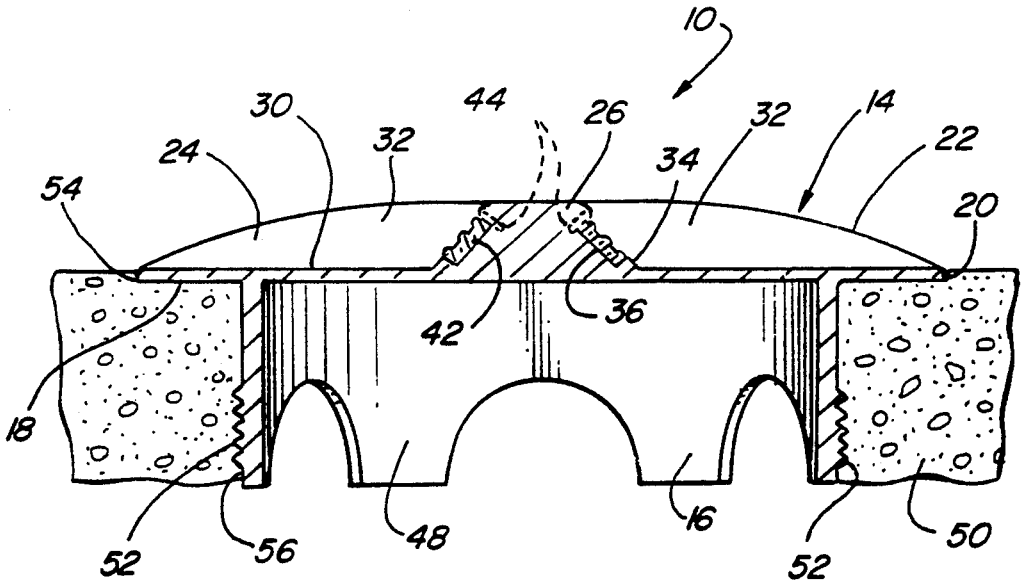
FIG. 4 is a sectional side view of a road marker according to the invention taken along lines 4—4 of FIG. 1.

As best shown in FIG. 1, the top section 14 is circular in shape and has a lower annular surface 18 extending between the mounting section 16 and an outer peripheral edge 20. A pair of dished surfaces 22 extend upwardly and inwardly from opposing sections of the peripheral edge 20 to define a pair of channels 24 extending therebetween. The pair of channels 24 are separated by a bridge portion 26 having a generally flat top surface 28 extending between the pair of dished surfaces 22. As shown in FIG. 4, each of the channels 24 has a generally planar lower surface 30 extending between a pair of side surfaces 32. The lower surface 30 and side surfaces extend inwardly to an inclined wall 34 of the bridge portion 26.

Figure 3:
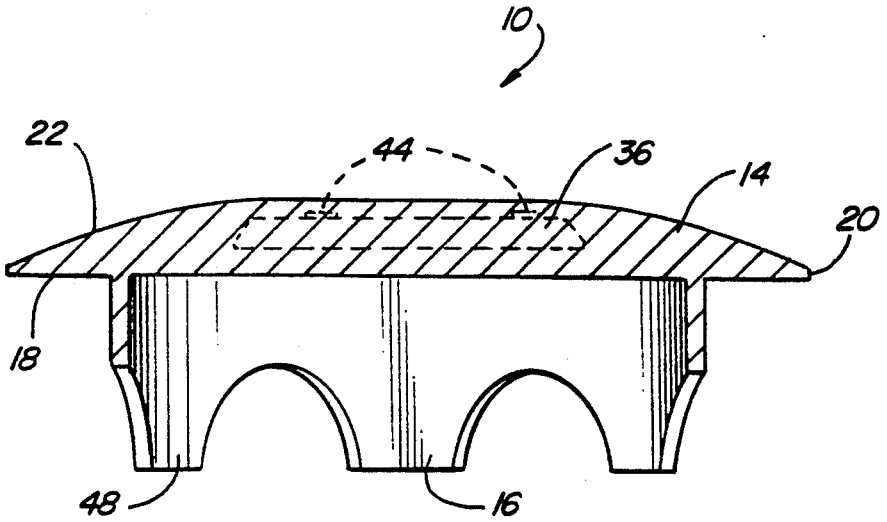
FIG. 3 is a sectional side view of a road marker according to the invention taken along lines 3—3 of FIG. 1.

As best shown in FIGS. 3 and 4, a recess 36 is formed in each of the pair of inclined walls 34 of the bridge portion 26 for receiving a signalling device 38. In the preferred embodiment, the signalling device 38 is of a glass bead type reflector known in the art as a "cats-eye" reflector. The cats-eye reflector includes rows of glass beads 40 mounted in a body 42 of molded composite material. The glass beads 40 have an outer hemispherical portion and a parabolically shaped portion. The glass beads 40 are mounted so the hemispherical portion of the bead extends outwardly from the body. The parabolically shaped portion is electro-coated with a light reflective material and is encased in the body 42 of composite material.

The body 42 of the signalling device is mounted in the recess 36 by a suitable method such as a press fit or by gluing the body with a suitable adhesive.

In the preferred embodiment, the base member is formed to accept one signalling device in each wall 34. One of the signalling devices generally reflects white light to oncoming traffic and the other signalling device may be colored to reflect red or amber light. In some cases, only one signalling device may be provided.

The inclined wall 34 is angled at a proper angle to direct oncoming light from a vehicle back to the vehicle. In the case of a cats-eye reflector, the wall extends from vertical at approximately 35°. However, it is within the scope of the invention to use with other signalling devices, such as cube-corner reflex reflectors. In such a case the angle of the wall will be greater.

As shown in FIG. 1, a pair of slots 44 are formed in the inclined wall 34 directly above the signalling device 38 to permit removal of the signalling device 38 from the base member 12. The slots 44 permit insertion of a tool such as a screwdriver to pry out the signalling device 28.

Extending from the inclined wall 34 of the bridge portion 26 is a lip or brow 46 disposed above the signalling device 38 to vehicle, as shown in FIGS. 1 and 4. The brow 46 extends outwardly a distance of approximately ⅛" from the inclined wall to provide protection to the glass beads of a cats-eye type reflector which are recessed under the brow. In the case of a cube corner reflex reflector, it is common to protect the outer surface of the cube corner reflector with an abrasion resistant coating to protect the reflector from scratching such as disclosed in U.S. Pat. No. 4,753,548. The brow will provide protection to the edge of the coating from wear caused by contact with a tire, as disclosed in copending patent application Ser. No. 527,754.

Figure 2:
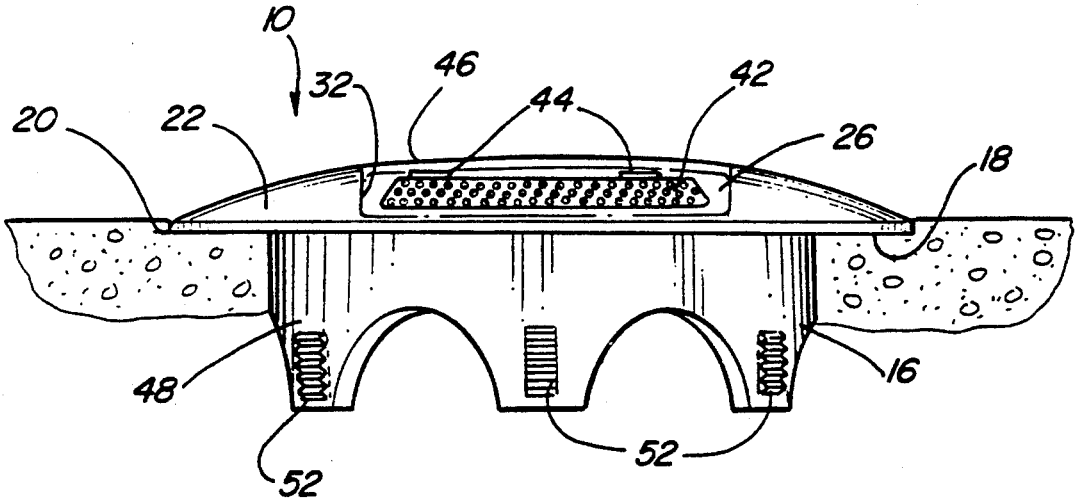
FIG. 2 is a side view of a snowplowable road marker shown in position within a road in accordance with the invention.

As best shown in FIGS. 2, 3, and 4, the mounting section 16 of the preferred embodiment is a cylindrical flange 48 extending downwardly from the annular surface 18 of the top section. The flange 48 may be formed of the same material as the top section in a unitary process. Alternatively, the flange 48 may be formed separately and secured to the top section 14. The flange 48 is secured to the road 50 in a conventional manner, such as a plurality of spaced apart grooves or teeth 52, as disclosed in U.S. Pat. No. 4,577,992, or by using a settable material such as epoxy or wet cement to flow around the flange and secure the marker in position.

The method of installation of the road marker requires preparation of two concentric bores, an outer bore 54 having a diameter equal to the diameter of the top section and an inner cylindrical bore 56 having a smaller diameter as shown in FIG. 4. The inner bore is formed to accept the flange 48 of the mounting section within. The bores may be formed in a single step by using a drilling tool having separate cutting surfaces for each bore. The drilling tool is provided with a stop so that the depth of the outer bore may be carefully set so that the annular surface 18 and peripheral edge 20 of the base member are positioned at a predetermined distance beneath a top surface 58 of the road. After forming the cylindrical inner bore, a center core is left in the inner bore. The center core is removed by chipping or breaking the core from the road. The base member 12 is then positioned in the road with the lower surface of each channel 24 aligned along the plane of the top surface 58 of the road as shown in FIG. 4.

Because the peripheral edge 20 of the base member is positioned below the top surface of the road, the snowplow blade contacts one of the dished surfaces 22 and is directed to ride over the road marker. The snowplow blade is prevented from contacting the peripheral edge of the marker to dislodge the marker from the road.

Above have been described what are presently considered to be the preferred embodiments of the invention, it will be understood that various modifications may be made herein, and it is intended to cover in the independent claims, all such modifications as fall within the true spirit and scope of the invention.

What is claimed is:

1. A snowplowable road marker for installation in a road having a top surface, said road marker comprising:

means for signalling; and a base member having a circular top portion and means for mounting said base member to said road, said means for mounting extending downwardly from said top portion, said top portion having an annular surface extending between an outer peripheral edge and said mans for mounting, said top portion further having a pair of diametrically opposed dished top surfaces extending upwardly and outwardly from said peripheral edge, said annular surface and said peripheral edge adapted to be mounted in a first ore at a predetermined depth below said top surface of said road, said base member further having means for mounting said means for signalling between said pair of top surfaces and a pair of channels disposed between said pair of top surfaces, each of said pair of channels having a generally planer lower surface extending generally along a plane aligned with said top surface of said road, said lower surface being spaced apart form said peripheral edge a distance equal to said predetermined depth.

2. The snowplowable road marker as defined in claim 1, wherein each of said channels comprises a lower surface spaced apart at a predetermined distance from said annular surface, said lower surface of each of said channels extending along a plane extending through said top surface of said road when said road marker is installed in said road.

3. The snowplowable road marker as claimed in claim 1, wherein said means for mounting further comprises a bridge portion extending between said pair of channels.

4. The snowplowable road marker as defined in claim 3, wherein said bridge portion has at least one inclined wall having a recess for mounting said means for signalling.

5. The snowplowable road marker as defined in claim 4, wherein said bridge portion further comprises a lip extending outwardly from said at least one wall and being positioned along said at least one wall above said recess.

6. The snowplowable road marker as defined in claim 1, wherein said means for signalling comprises a plurality of glass beads mounted in a body.

7. The snowplowable road marker as defined in claim 1, wherein said means for signalling comprises a cube corner reflex reflector.

8. The snowplowable road marker as defined in claim 1, wherein said means for mounting further comprises a cylindrical flange.

9. A snowplowable road marker for installation in a road having a top surface, said road marker comprising:

means for signalling; and a base member having a top portion and means for mounting said base member to said road, a bridge portion extending between a pair of dished top surfaces, said bridge portion having at least one recess formed in an inclined wall and a lip being formed to extend outwardly from said bridge portion and being positioned above said recess to reduce contact between a tire of a vehicle and said means for signalling.

10. The snowplowable road marker as defined in claim 9, wherein each of said channels comprises a lower surface spaced apart at a predetermined distance from said annular surface, said lower surface of each of said channels extending along a plane extending through said top surface of said road when said road marker is installed in said road.

11. The snowplowable road marker as claimed in claim 9, further comprising a pair of channels disposed between said pair of top surfaces.

12. The snowplowable road marker as defined in claim 9, wherein said means for signalling comprises a plurality of glass beads mounted in a body.

13. The snowplowable road marker as defined in claim 9, wherein said means for signalling comprises a cube corner reflex reflector.

14. The snowplowable road marker as defined in claim 9, wherein said means for mounting further comprises a cylindrical flange.

15. A method of installation of a snowplowable road marker in a road having a top surface, said road marker having a top portion with a peripheral edge, and an annular lower surface, said road marker further having a mounting portion extending therefrom, said method including the steps of:

forming an outer bore having a surface portion extending radially at a first predetermined depth below said top surface of said road;

forming an inner bore coaxially with said outer bore to a second predetermined depth greater than said first predetermined depth of said outer bore; and inserting a road marker in said outer bore with said lower surface and said peripheral edge disposed on said radially extending surface below said road surface, permitting said mounting portion to extend into said inner bore.

* * * * *

UNITED STATES PATENT AND TRADEMARK OFFICE

CERTIFICATE OF CORRECTION

PATENT NO. : 5,308,186
DATED : May 3, 1994
INVENTOR(S) : Peter Hedgewick

It is certified that error appears in the above-indentified patent and that said Letters Patent is hereby corrected as shown below:

Column 4, line 51, delete "ore" and insert --bore--.

Signed and Sealed this

Sixth Day of September, 1994

*Attest:*

*Attesting Officer*

BRUCE LEHMAN

*Commissioner of Patents and Trademarks*